US006514088B1

(12) United States Patent
Yatskov et al.

(10) Patent No.: US 6,514,088 B1
(45) Date of Patent: Feb. 4, 2003

(54) UNIFORM PRESSURE PAD FOR ELECTRICAL CONTACTS

(75) Inventors: Alexander I. Yatskov, Kenmore, WA (US); Stephen V. R. Hellriegel, Bainbridge Island, WA (US)

(73) Assignee: Cray Inc., Seattle, WA (US)

( * ) Notice: Subject to any disclaimer, the term of this patent is extended or adjusted under 35 U.S.C. 154(b) by 0 days.

(21) Appl. No.: 09/705,366

(22) Filed: Nov. 3, 2000

(51) Int. Cl.[7] ..... H01R 12/00
(52) U.S. Cl. ..... 439/67; 437/493
(58) Field of Search ..... 439/66, 67, 78, 439/83, 329, 378, 428, 493, 571, 573; 101/305, 318, 327

(56) References Cited

U.S. PATENT DOCUMENTS 4,538,865 A * 9/1985 Wakabayashi et al. ..... 439/66
5,059,129 A 10/1991 Brodsky et al. ..... 439/67
5,273,440 A 12/1993 Ashman et al. ..... 439/71
5,873,740 A 2/1999 Alcoe et al. ..... 439/67
5,947,750 A * 9/1999 Alcoe et al. ..... 439/67

FOREIGN PATENT DOCUMENTS

EP 0 675 569 A1 10/1995
EP 1 024 554 A2 8/2000

* cited by examiner

*Primary Examiner*—Gary Paumen
*Assistant Examiner*—James R. Harvey
(74) *Attorney, Agent, or Firm*—Seed IP Law Group PLLC

(57) ABSTRACT

A uniform pressure pad formed of a resilient material having a plurality of uniform pressure areas formed between a row and column array of cavities formed in the pad thickness. The cavities surrounding the pressure areas allow the resilient pad material to flow evenly thereby providing uniformity in the pressure applied to each pressure area.

7 Claims, 8 Drawing Sheets

UNIFORM PRESSURE PAD FOR ELECTRICAL CONTACTS

TECHNICAL FIELD

This invention relates to ensuring uniform contact in electrical connector, and in particular to a resilient pressure pad providing uniform contact pressure for multiple electrical contacts.

BACKGROUND OF THE INVENTION

Flexible conductor strips, commonly referred to as "flex strips," are often used to electrically interconnect electrical devices such as circuit boards in an assembly, connectors on a circuit board, and other electrical devices that may experience relative motion. Flex strips are generally well-known in the art as multiple flat electrical conductors usually laid out in parallel strips and encased in a flexible nonconductive material. The resulting flexible electrical interface, i.e., the flex strip, can be bent and twisted within limits. Often, electrical connection means are provided at either end of the conductive strip by either pins or holes for insertion of male pins. In such instances, electrical interconnection is commonly provided by solder joints. Electrical contact can be made by other means as well. For example, button contacts formed at the ends of the individual constructive strips can be held in contact with mating contact pads on the electrical device. In practice, this latter type of electrical contact is not unlike an over center switch wherein one contact is stationary or fixed and the other contact is pressed against the stationary contact with a spring force. Generally such switches are limited to a single pair of mating contacts in part because of a need to apply uniform contact pressure to each of the pairs of mating electrical contacts. Uniform contact pressure is difficult to ensure when a single spring is used to uniformly load more than one contact pair. The difficulty of supplying uniform pressure is greatly increased when the number of electrical contact pairs is increased. Greatly increasing the number of contacts, reducing the contact pad size, and decreasing the current passed through the contact interface are all factors that exacerbate the already difficult problem.

Generally, the prior art solutions provide a non-uniform loading across an array of rows and columns of contact pad pairs that either fails to provide reliable contact pressure to some of the contact pads, or load some of the contact pads so severely that they are crushed. Therefore, a mechanism providing truly uniform loading across an array of contact pad is desirable.

SUMMARY OF THE INVENTION

The present invention provides a clamp for coupling electrical contacts on a flexible conductor strip, or flex strip, with a substantially uniform pressure against mating contacts on another device, such as a circuit board. The clamp includes a housing formed with a recess of substantially uniform depth. A thin pad of elastomeric insulation material is sized to fit snugly within the width and breadth of the housing. The elastomeric pad is formed with a substantially uniform thickness greater than the depth of the recess in the housing and thus extends beyond the recess depth. An array of substantially uniform pressure areas are formed in the pad surface at interstices between an array of evenly spaced rows and columns of cavities formed in the pad thickness. Clamping means, for example, one or more threaded fasteners, secures the housing to a mating surface, such as a circuit board.

According to one aspect of the invention, a rigid metal backing plate is provided opposite the recess in the housing to strengthen the housing. Preferably, the clamping means also secures the backing plate to the mating surface.

According to one aspect of the invention, the resilient pad thickness is approximately double that of the depth of the recess in the housing.

According to another aspect of the invention, the cavities formed in the elastomeric pad are cylindrical cavities extending approximately halfway through the pad thickness.

According to other aspects of the invention, the present invention provides a various methods for clamping multiple rows and columns of electrical contacts with substantially uniform pressure.

DETAILED DESCRIPTION OF THE INVENTION

Figure 1:
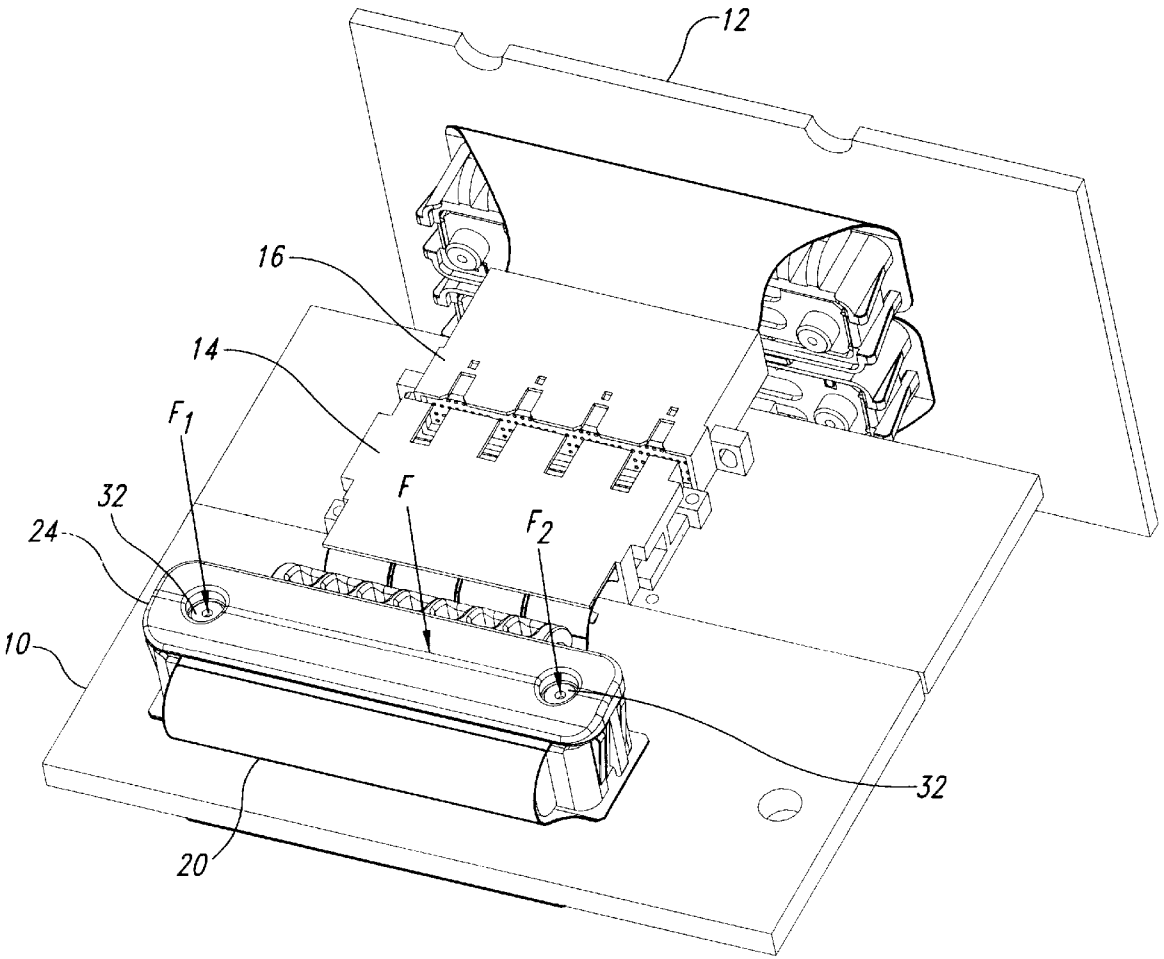
FIG. 1 illustrates one embodiment of the present invention, wherein the uniform pressure pad of the invention provides substantially uniform loading to an array of rows and columns of contact pads formed on a flexible conductor strip or "flex strip"

FIG. 1 illustrates one embodiment of the invention, wherein the uniform pressure pad of the invention provides substantially uniform loading to an array of rows and columns of contact pads formed on a flexible conductor strip or "flex strip." In FIG. 1, a circuit board 10 is interconnected to another circuit board 12 by insertion of connector 14 on circuit board 10 into a stationary mating connector 16 mounted on circuit board 12. Connector 14 is movable relative to circuit board 10 so that after circuit board 10 is physically seated relative to circuit board 12. Connector 14 is subsequently mated with connector 16 thereby reducing the opportunities for damage to either of connectors 14 and 16 by overly aggressive insertion when circuit board 10 is seated. Such an application requires that connector 14 be movable relative to circuit board 10. Therefore, connector 14 is desirably electrically interconnected with circuit board 10 via a flexible conductor strip 20. In order to accommodate a large number of electrical interconnections between circuit board 10 and circuit board 12, connectors 14 and 16 necessarily make a large number of connections. Thus, flexible conductor 20 also makes a large number of connections between connector 14 and circuit board 10. Such a large number of connections are desirably made using an array of rows and columns of contact pads 22 formed at the ends of the conductors in flex strip 20, as described in more detail below. A connector clamp 24 is provided by the invention to provides a clamping force F for holding the contact pads of flex strip 20 against mating contact pads on circuit board 10. According to the invention, clamping force F is preferably provided as two cooperating contact forces F1 and F2 at either side of flex strip 20. Cooperating forces F1 and F2 are provided, for example, by screws passing through clamp 24 into a threaded nut or plate (not shown) on an opposing side of circuit board 10, or another suitable clamping means.

Figure 2:
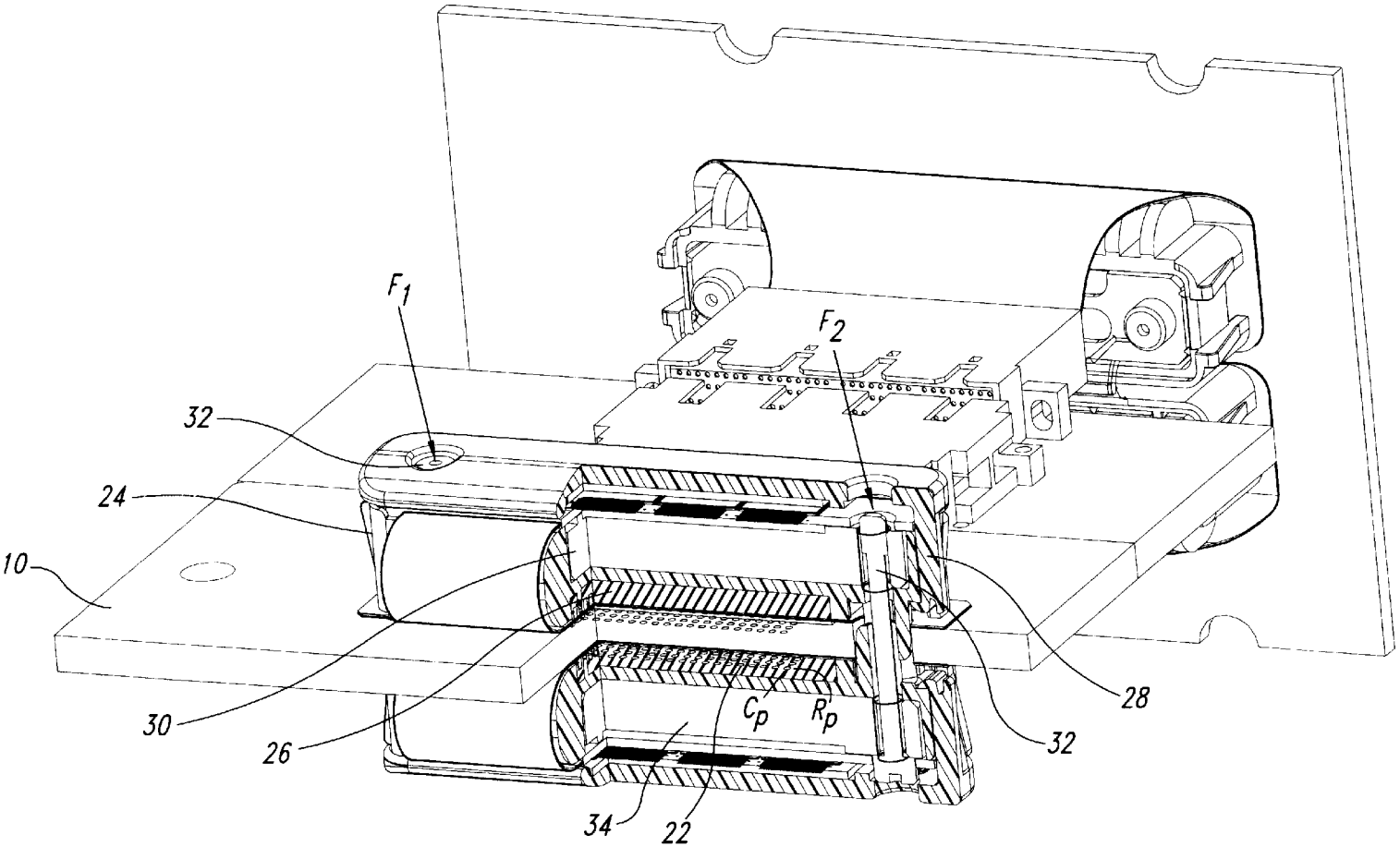
FIG. 2 is a section view taken through the connector clamp of the present invention.
Figure 3:
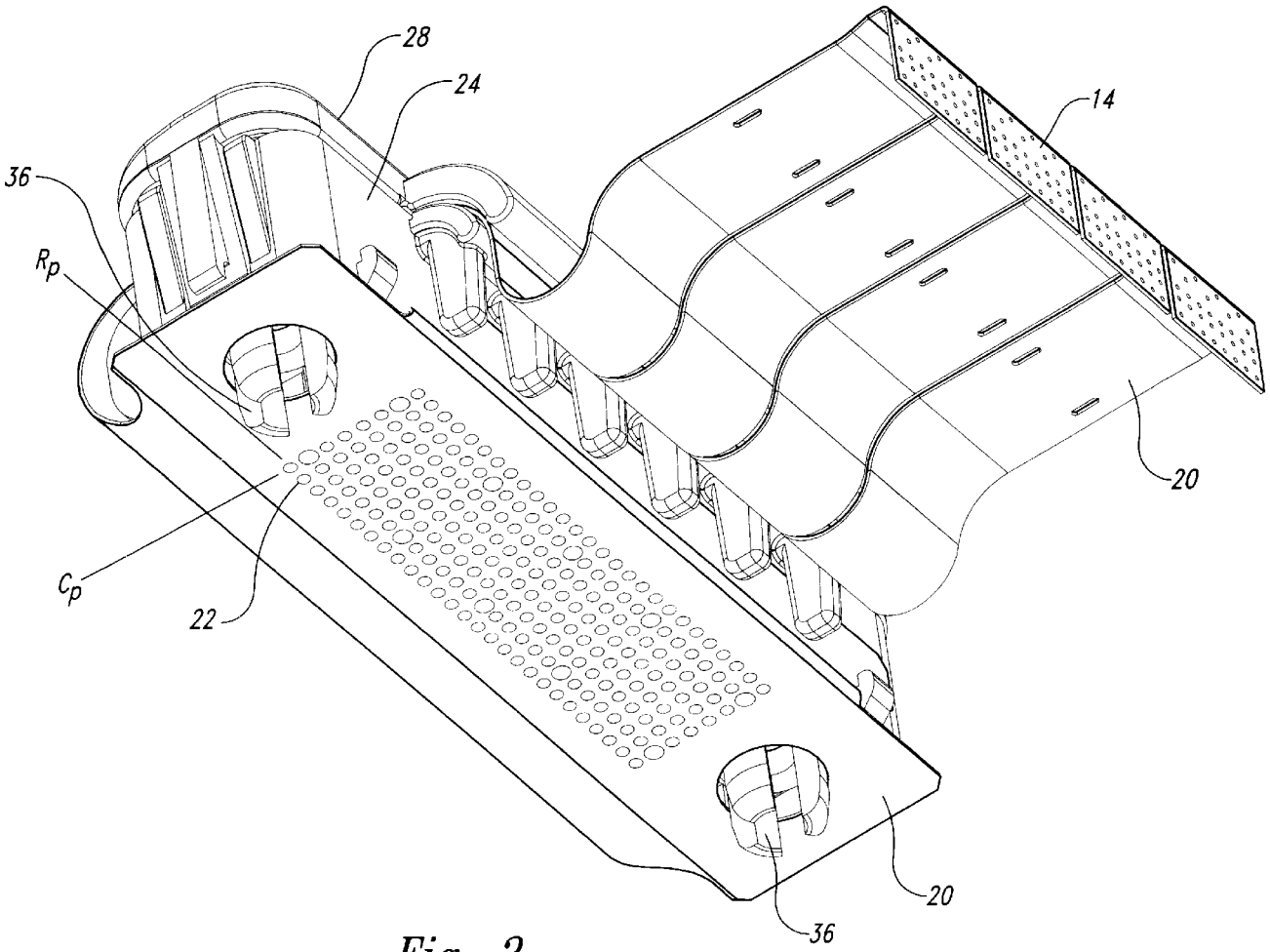
FIG. 3 shows the connector clamp of the invention in combination with rows and columns of contact pads formed on flexible conductor strip to be mated with contact pads on another device.

FIG. 2 is a section view taken through circuit board 10 and connector clamp 24. Circuit board 10 includes multiple electrical contact pads preferably laid out in an array of closely spaced rows and columns. The array of mating rows $R_P$ and columns $C_P$ of contact pads 22 formed on flex strip 20 are aligned with those on circuit board 10. The section view of FIG. 2 shows a portion of the array of mating rows $R_P$ and $C_P$ of contact pads with the overlaying structure cut away for visibility of the pads in position with the connector. The clamping mechanism of the invention is incorporated into connector clamp 24 (hereinafter clamp 24). Clamp 24 includes a resilient pad 26 fitted into a housing 28 backed with a steel plate 30. Clamping forces F1 and F2 are provided, as mentioned above, by one of several known clamping means. For example, screws 32 (one shown) pass through holes in each of steel plate 30 and pad housing 28, and through mating holes in circuit board 10. Screws 32 are threadedly engaged on an opposite side of circuit board 10, for example, by a threaded plate (shown), a nut, or another suitable threaded member. Steel backing plate 30 is clamped securely against circuit board 10 by screws 32. Pad housing 28 transfers the clamping force from backing plate 30 through to resilient pad 26 thereby pressing resilient pad 26 firmly against flexible conductor strip 20 and making electrical contact with circuit board 10 by pressing mating contact pads 22 together with contact pads on circuit board 10. However, those of ordinary skill in the art generally recognize that when the components of clamp 24 are elongated to clamp a large number of electrical contacts, clamping pressure is uneven. Non-uniform clamping pressure may clamp some of the contacts so tightly that they are crushed, while other contact so lightly that any signal passed therethrough is subject to noise. In contrast, the present invention captures resilient pad 26 within substantially rigid housing structure 28 and provides an array of cavities formed in resilient pad 26 configured to fall in the spaces between the rows $R_P$ and columns $C_P$ of contact FIG. 3 shows the rows $R_P$ and columns $C_P$ of contact pads 22 formed on flexible conductor strip 20. In the application illustrated, flex strip 20 curves away from the position of connector 14 (not shown) and folds around connector clamp 24 into a position on an extreme side of clamp 24. Flex strip 20 is held in place by one or more posts 36 projecting from the surface of clamp 24 through mating holes in conductor strip 20. The rows $R_P$ and columns $C_P$ of contact pads 22 are thus positioned on the face of clamp 24. The clamp elements, including steel backing plate 30, pad housing 28, and resilient pad 26, are fitted behind the contact pad area of flexible conductor strip 20 and are not shown.

Figure 4:
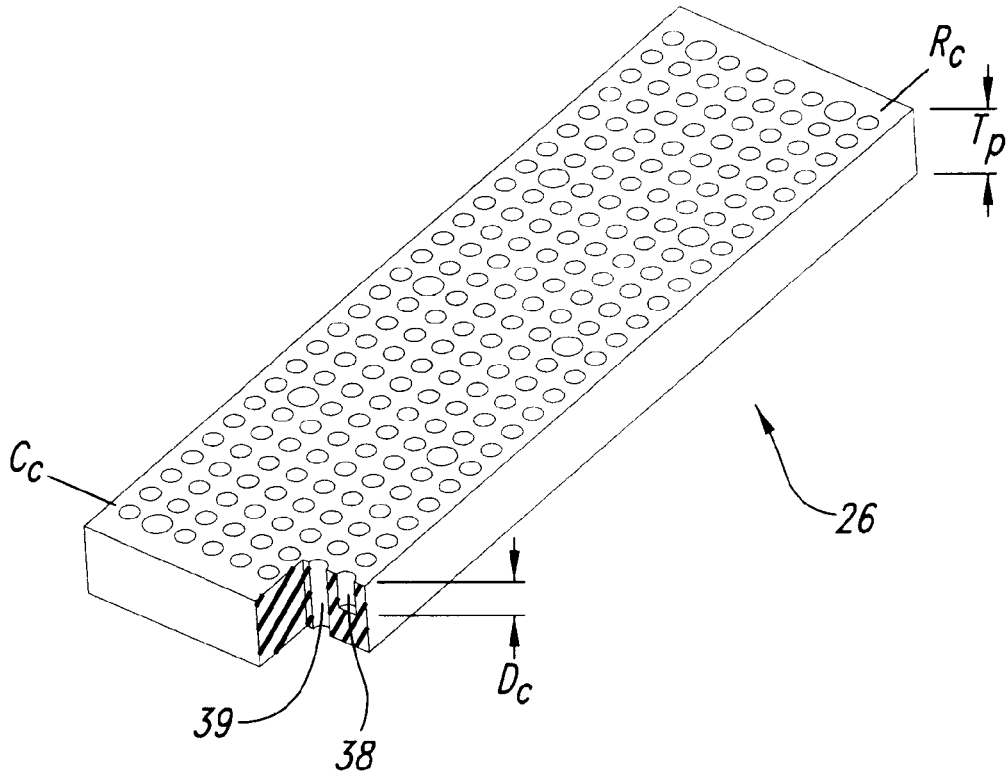
FIG. 4 is an enlarged view of the resilient pad of the invention.

FIG. 4 is an enlarged view of resilient pad. Preferably, an elastomeric material is used to form resilient pad 26. For example, a silicon rubber or other suitable moldable material forms resilient pad 26. The resilient pad material is a relative soft rubber having a durometer in the Shore A range, preferably in the 30–60 Shore A range. Other factors such as thermal, aging, and insulation properties along with resiliency are considered in selection of the material. Resilient pad 26 is formed in a generally rectangular shape matched to that of the array of contact pads 22 on conductor strip 20. Resilient pad 26 is formed with a thickness $T_P$ that is defined in part by other elements of clamp 24. Resilient pad 26 is formed with a large number of cavities 38 arranged in rows $R_C$ and columns $C_C$ configured to fall within the interstices between rows $R_P$ and columns $C_P$ of contact pads 22 on electrical conductor strip 20, as described in greater detail below. According to one embodiment of the invention, cavities 38 are round holes formed to a depth D about halfway through thickness $T_P$ of resilient pad 26, but may be formed to a lesser or greater depth, up to and including all the way through the thickness $T_P$ of resilient pad 26. Resilient pad 26 also includes multiple through holes 39 for mating with position control pegs formed in mating pad housing 28 (shown in FIG. 5) and securing pad 26 relative to contact pads 22 on flex strip 20.

Figure 5:
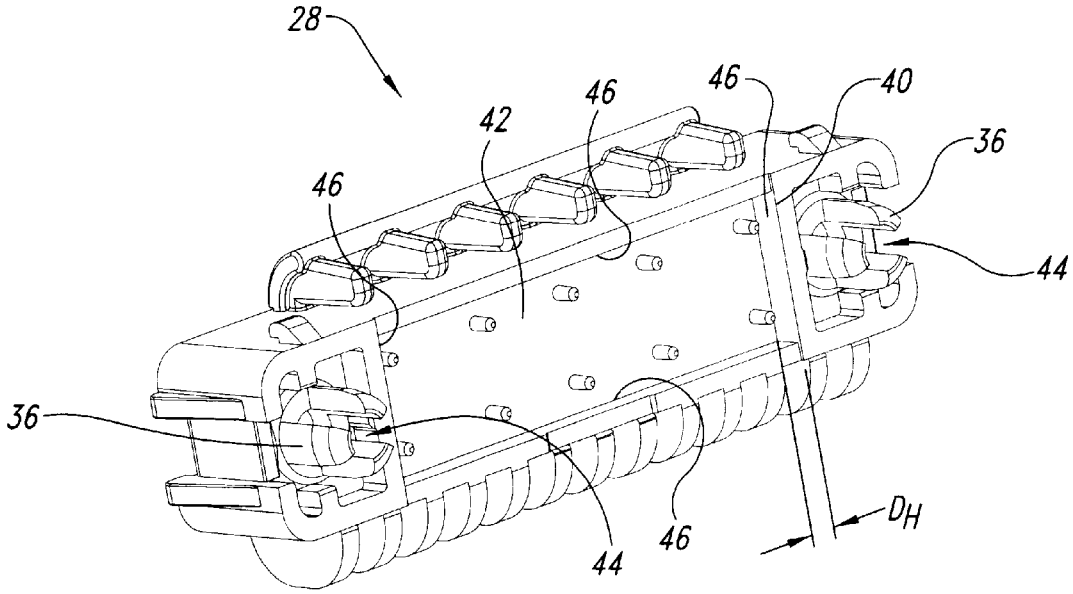
FIG. 5 is an enlarged view of pad housing 28 of clamp 24, and shows the recess 40 configured to accept resilient pad 26.

FIG. 5 is an enlarged view of pad housing 28 of clamp 24, and shows the recess 40 configured to accept resilient pad 26. Recess 40 is formed with a generally rectangular shape sized relatively larger than the rectangular area defined by rows $R_C$ and columns $C_C$ of contact pads 22 on flexible conductor strip 20, as is described in greater detail below. Recess 40 is formed with a substantially flat or planar surface 42, which is formed generally perpendicularly to the axes of holes 44 through which screws 32 (shown in FIGS. 1 and 2) pass to clamp against circuit board 10. Recess 40 is further formed with four perpendicular walls 46 that are configured to accept and snugly encompass resilient pad 26. Depth $T_H$, of recess 40 is configured relative to thickness $T_P$ of resilient pad 26 (shown in FIG. 4) such that depth $D_H$ is about onehalf the thickness $T_P$ of resilient pad 26. A plurality of pegs 48 project perpendicularly from planar surface 42 at the bottom of recess 40. Pegs 48 mate with through-holes 38A in resilient pad 26 to maintain alignment between cavities 38 of resilient pad 26 and contact pads 22 on conductor strip 20.

Figure 6:
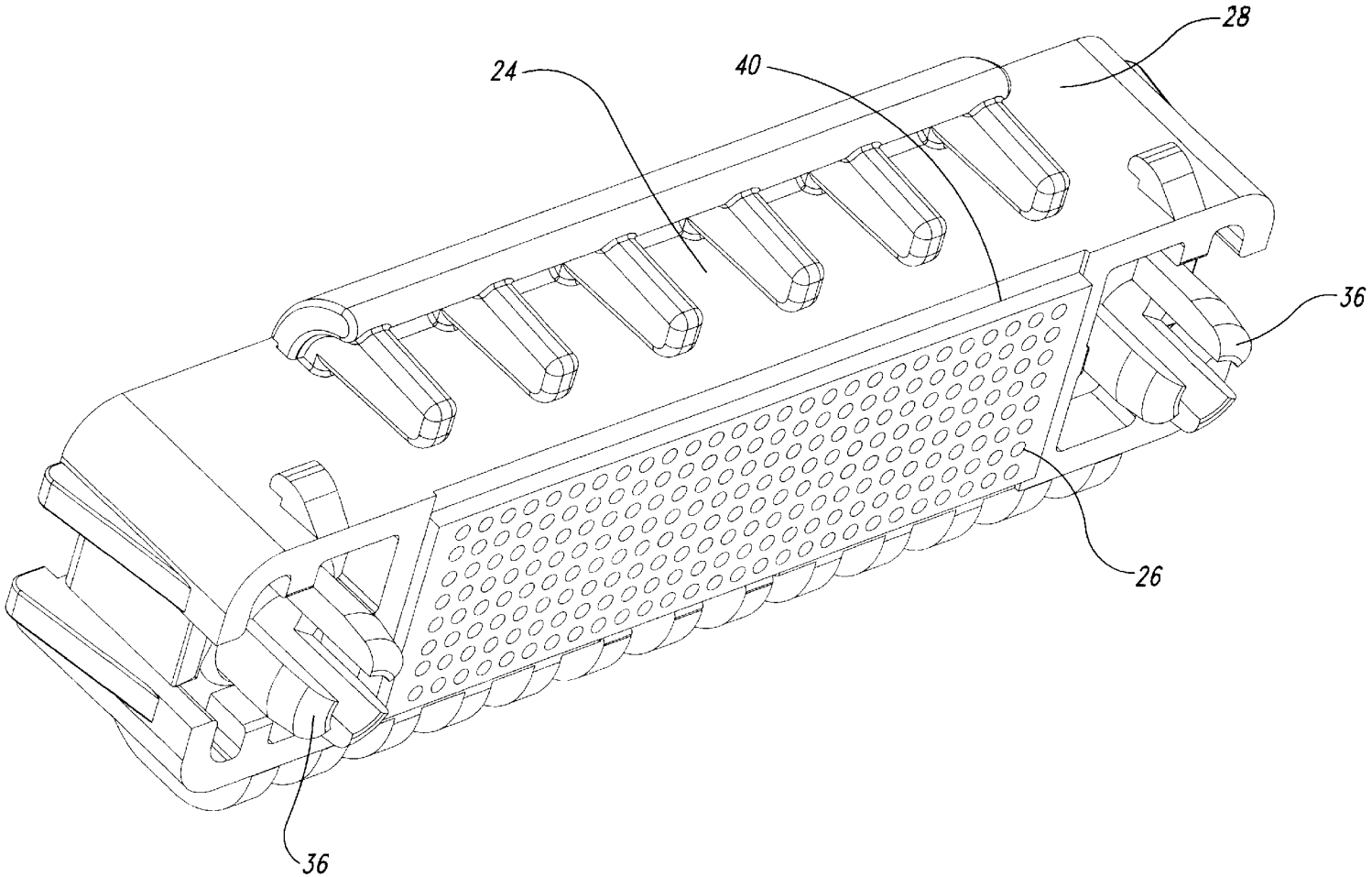
FIG. 6 illustrates the combination of the resilient pad the invention with the pad housing the invention.

FIG. 6 illustrates the combination of resilient pad 26 with pad housing 28. In operation, resilient pad 26 fits into recess 40 in pad housing 28 with a slight interference fit so that the outer walls of resilient pad 26 fit snugly against the inner walls 46 of recess 40. Furthermore, predetermined ones of cavities 38, through-holes 39, mate with pegs 48 projecting from planar surface 42 in the bottom of recess 40. Pegs 48 supply additional alignment of cavities 38 relative to pad housing 28 in general and relative to posts 36 in particular.

Figure 7:
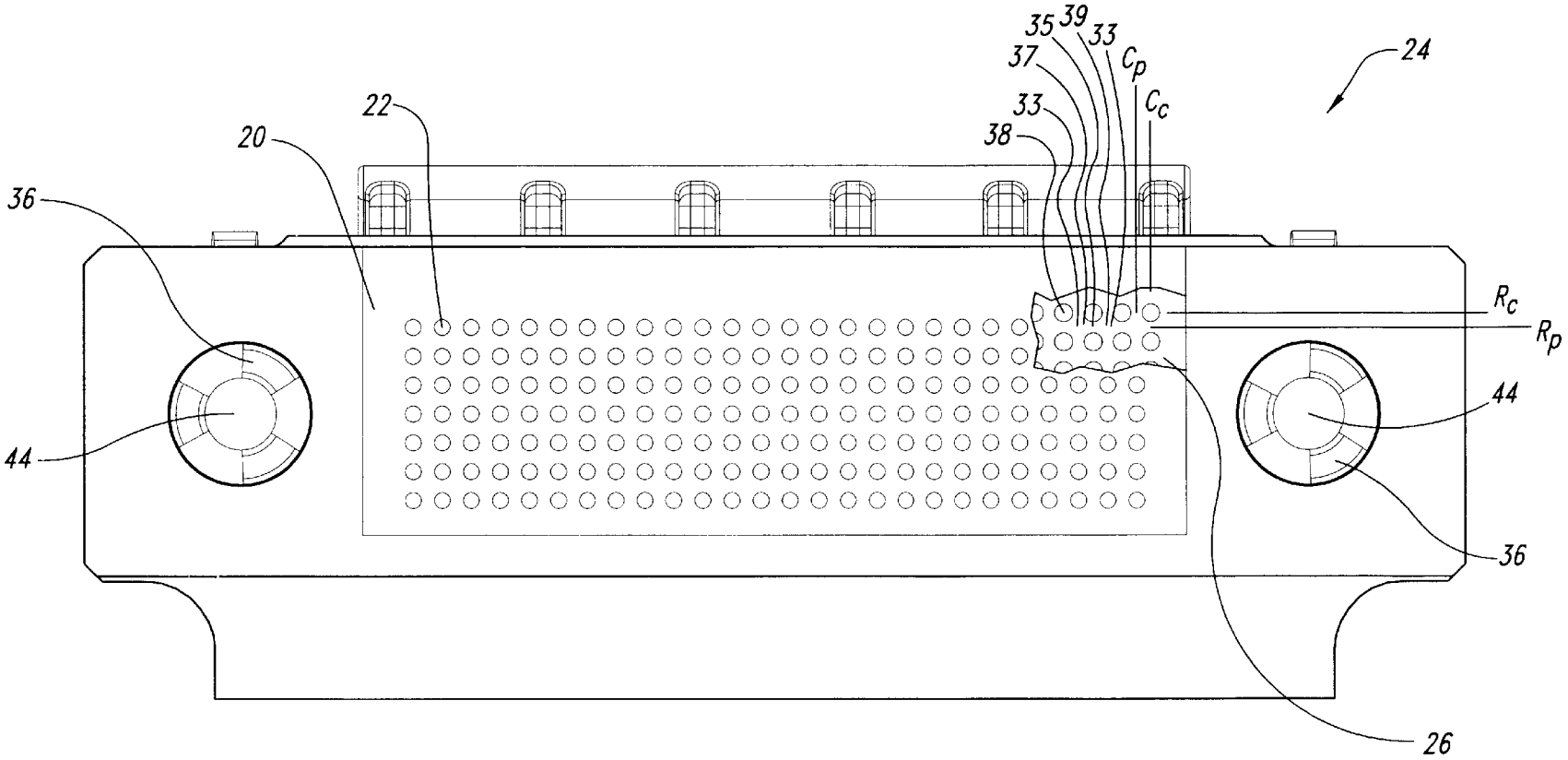
FIG. 7 is a bottom view of the connector clamp of the invention, including the flexible conductor strip to be clamped.
Figure 8:
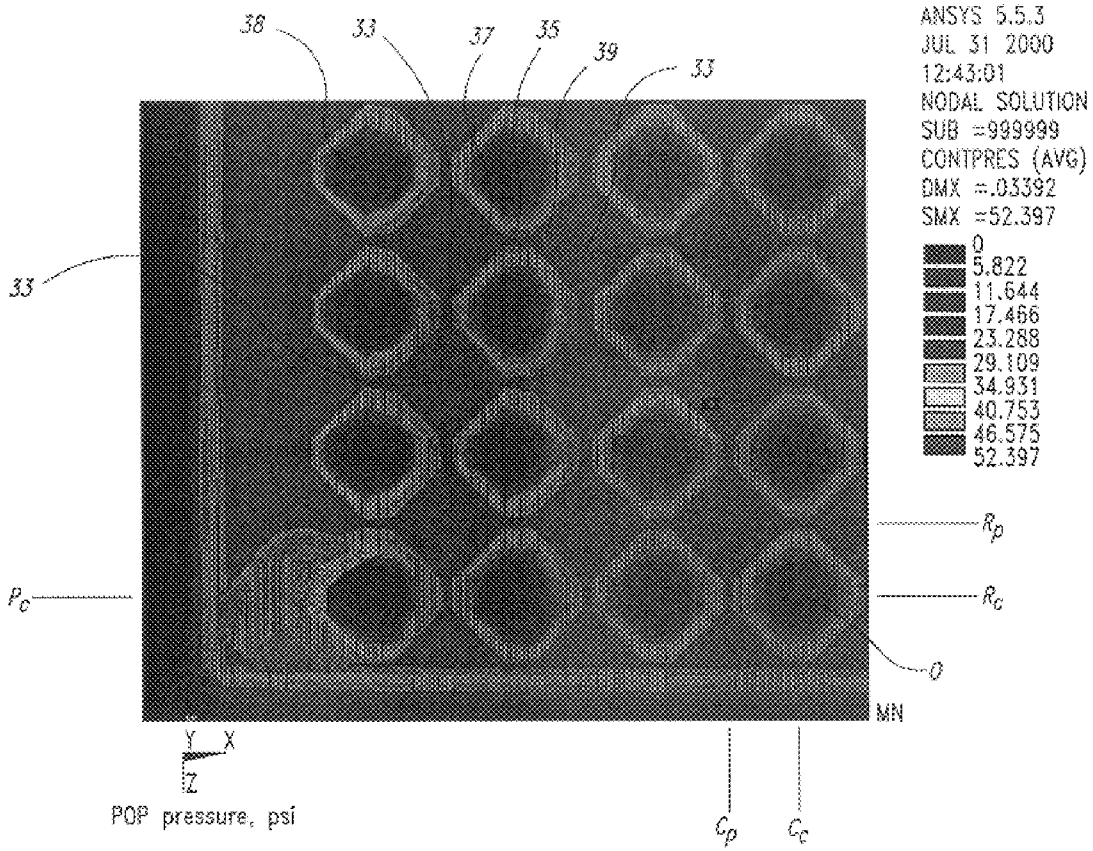
FIG. 8 illustrates the results of a finite element analysis of the compression force supplied by resilient pad and clamp of the invention according to one embodiment of the invention.

FIG. 7 is a bottom view of the connector clamp 24, including flexible conductor strip 20. As shown in FIG. 7 and described above, posts 36 pass through holes in flexible conductor strip 20 and align it with clamp 24. Conductor strip 20 is thus aligned with resilient pad 26 and cavities 38 therein. Contact pads 22 are interstitially aligned cavities 38, such that each contact pad 22 falls in an interstice between cavities 38. In other words, the rows $R_P$ of contact pads 22 are offset one-half of the center-to-center spacing between adjacent rows $R_C$ of cavities 38, while the columns $C_P$ of contact pads 22 are spaced one-half the distance between adjacent columns $C_C$ of cavities 38. Thus each of the plurality of contact pads 22 is in direct contact with a respective one of a plurality of solid portions 33, or pressure regions, of the resilient pad 26 surrounded by multiple cavities 38 each equally distanced from the center of a corresponding contact pad 22, thus having a plurality of webbing members 35 between the cavities 38, each of the webbing members 35 connecting to one pressure region at a first end 37 and to an adjacent pressure region at a second end 39, as shown in FIGS. 7 and 8. The described configuration ensures that each contact pad 22 is engaged with a mating contact pad on circuit board 10 with the same amount of contact pressure. Functionally, cavities 38 surrounding each contact pad 22 eliminate variation in the pressure normally applied by a resilient pad due to the usual variations in the restriction on material flow in a solid resilient pad. In contrast to a solid resilient pad, cavities 38 provide a space for material to flow when pressure is applied, thus eliminating the variations in material flow and resulting in a uniform response to the pressure applied by clamping screws 32 through holes 44 in pad housing 28.

FIG. 8 illustrates the results of a finite element analysis of the compression force supplied by resilient pad 26 in the configuration described herein. As shown, zero pressure is applied at the row $R_C$ and column $C_C$ locations of cavities 38 in resilient pad 26. The reduction and change in shape of cavities 38 indicate the material flow into those areas. The pressure applied by resilient pad 26 increases outwardly from the locations of cavities 38 to a maximum at the locations mid-way between each row $R_C$ and each column $C_C$ of cavities 38. These areas of maximum pressure correspond to the row $R_P$ and column $C_P$ locations of contact pads 22 in the assembly. As illustrated, the pressure applied at row $R_P$ and column $C_P$ locations of contact pads 22 is substantially uniform, except at outside rows and columns as shown by the low pressure area outboard of the row $R_{C1}$ column $C_{C1}$, of the corner cavity 38. Given the desire for uniform pressure application to each of the contact pads 22, preferred embodiments of the invention provide extra rows and/or columns of cavities outboard from the pressure areas engaging contact pads 22 on flexible conductor strip 20.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A clamp for coupling electrical contacts, comprising:

a housing having a recess;

a resilient pad having upper and lower regions, a combined thickness of the upper and lower regions exceeding the depth of the recess;

the lower region of the pad sized to fit within the recess;

a plurality of pressure regions formed in the upper region of the pad, each of the plurality of pressure regions configured to exert force on a respective one of a plurality of contacts on a substrate;

a plurality of webbing members formed in the upper region, each one of the plurality of webbing members connecting to one of the plurality of pressure regions at a first end of the webbing member and to an adjacent one of the pressure regions at a second end of the webbing member, upper surfaces of the plurality of webbing members being substantially coplanar with upper surfaces of the plurality of pressure regions; and a plurality of cavities formed in the upper region in spaces bounded by pressure regions and webbing members, forming thereby a matrix of pressure regions and webbing members with interstitial cavities.

2. The clamp of claim 1 wherein the each of the plurality of cavities is cylindrical in shape.

3. The clamp of claim 1, further comprising:

a plurality of projections formed on the housing within the recess; and an additional plurality of cavities formed in the lower region and configured to mate with the plurality of projections.

4. The clamp of claim 1 wherein the substrate is a first substrate, and further comprising a second substrate having a plurality of contact pads corresponding to the plurality of contacts.

5. The clamp of claim 4 wherein:

the housing is configured to couple with the second substrate;

the housing includes alignment means configured to align the first substrate with the second substrate and each of the plurality of contacts of the first substrate with a respective one of the plurality of contact pads of the second substrate; and the alignment means is also configured to align each of the plurality of pressure regions of the resilient pad with the respective one of the contacts of the first substrate.

6. The clamp of claim 1 wherein the pressure regions are arranged in an evenly spaced array of rows and columns.

7. The clamp of claim 1 wherein the pressure regions are arranged in an evenly spaced hexagonal array.

* * * * *